United States Patent [19]

Iwamoto et al.

[11] Patent Number: 4,615,632

[45] Date of Patent: Oct. 7, 1986

[54] SLIDE TYPE COSMETIC CONTAINER WITH COMPOUND SCREW

[75] Inventors: Hisao Iwamoto, Odawara; Keiji Jinbo, Kanagawa; Yoichi Iwamoto, Funabashi, all of Japan

[73] Assignee: Kanebo Limited, Tokyo, Japan

[21] Appl. No.: 643,988

[22] Filed: Aug. 24, 1984

[30] Foreign Application Priority Data

Aug. 25, 1983 [JP] Japan ..... 58-131851[U]

[51] Int. Cl.[4] ..... A45D 40/06; A45D 40/04

[52] U.S. Cl. ..... 401/69; 401/64; 401/78; 401/87; 401/95

[58] Field of Search ..... 401/68, 69, 71, 77, 401/78, 95, 63, 64, 86, 87, 98

[56] References Cited

U.S. PATENT DOCUMENTS

| | | | |
|---|---|---|---|
| 2,395,710 | 2/1946 | Anderson | 401/69 |
| 2,429,328 | 10/1947 | Rault | 401/64 |
| 3,323,641 | 6/1967 | Landen | 401/86 |
| 3,677,654 | 7/1972 | Davis | 401/63 |
| 3,990,577 | 11/1976 | Delia | 401/78 |

FOREIGN PATENT DOCUMENTS

| | | | |
|---|---|---|---|
| 2291717 | 6/1976 | France | 401/78 |
| 50-31075 | 10/1975 | Japan . | |

*Primary Examiner*—Steven A. Bratlie
*Attorney, Agent, or Firm*—Armstrong, Nikaido, Marmelstein & Kubovcik

[57] ABSTRACT

A slide type cosmetic stick vessel has a middle saucer for holding a cosmetic stick, which has an engaging projection formed on the outer wall thereof, a body cylinder having a longitudinal guide groove through which the engaging projection slides, a threaded cylinder fitted on the periphery of the body cylinder, the threaded cylinder having a right-hand flight groove with which the engaging projection is engaged, a cover cylinder in which the threaded cylinder is inserted and secured, the cover cylinder having a second engaging projection formed on the outer wall of the lower portion thereof, a middle cylinder having a left-hand flight groove with which the second engaging projection is engaged, the left-hand flight groove being formed on the inner circumferential wall of the lower portion of the middle cylinder, and a longitudinal engaging groove formed on the wall of the middle cylinder, a slide cylinder secured to the outer wall of the lower end of the body cylinder and having a rotation-stopping piece formed on the outer wall thereof, and a bottomed outer cylinder in which the middle cylinder is inserted and secured, wherein the middle saucer and the slide cylinder are slidable in the longitudinal direction.

7 Claims, 9 Drawing Figures

SLIDE TYPE COSMETIC CONTAINER WITH COMPOUND SCREW

BACKGROUND OF THE INVENTION

1. Field of the Invention

The invention relates to an improved slide type vessel for a cosmetic stick such as lipstick. More particularly, the present invention relates to a novel slide type cosmetic stick vessel comprising a cosmetic stick container portion in which a cosmetic stick slides and is contained and a slide portion which slides in the container portion in the longitudinal direction.

2. Description of the Prior Art

Recently, slide type cosmetic stick vessels having a smaller size and a shape suitable for handling are desired. However, a vessel in which the size is simply diminished is defective in that the operation of delivering out a cosmetic stick becomes difficult and the vessel is difficult to hold at the painting operation.

As means for eliminating the above disadvantage, Japanese Examined Patent Publication No. 50-31075 proposes a cosmetic stick vessel having such a structure that the vessel is extended to a length suitable for the painting operation when the cosmetic stick is actually painted and the vessel is contracted when the cosmetic stick is contained. However, this structure is complicated and the number of parts is increased, and the manufacturing cost is inevitably increased. Moreover, since the mechanism for delivering out the cosmetic stick is arranged in series to the mechanism for extending and contracting the vessel, the length of the cosmetic stick to be contained in the vessel is relatively short as compared with the length of the vessel in the contracted state.

SUMMARY OF THE INVENTION

The present invention is to eliminate the above defects of the conventional techniques. More specifically, in accordance with the present invention, there is provided a slide type cosmetic stick vessel comprising a middle saucer for holding a cosmetic stick, which has an engaging projection formed on the outer wall thereof, a body cylinder having a longitudinal guide groove through which the engaging projection slides, a threaded cylinder fitted on the periphery of the body cylinder, said threaded cylinder having a right-hand flight groove with which the engaging projection is engaged, a cover cylinder in which the threaded cylinder is inserted and secured, said cover cylinder having a second engaging projection formed on the outer wall of the lower portion thereof, a middle cylinder having a left-hand flight groove with which the second engaging projection is engaged, said left-hand flight groove being formed on the inner circumferential wall of the lower portion of the middle cylinder, and a longitudinal engaging groove formed on the wall of the middle cylinder, a slide cylinder secured to the outer wall of the lower end of the body cylinder and having a rotation-stopping piece formed on the outer wall thereof, and a bottomed outer cylinder in which the middle cylinder is inserted and secured, wherein the middle saucer and the slide cylinder are slidable in the longitudinal direction.

DESCRIPTION OF THE PREFERRED EMBODIMENTS

Figure 1:
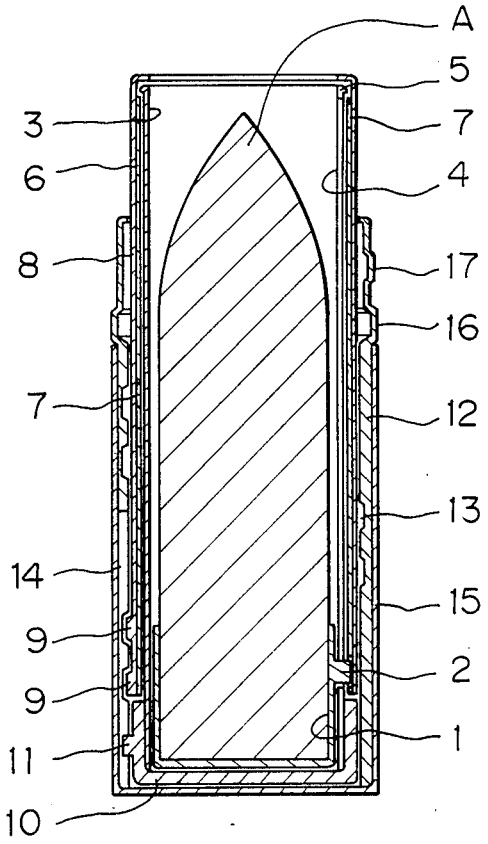
FIG. 1 is a sectional front view showing an embodiment of the present invention in the contracted state for containing a cosmetic stick therein.
Figure 2:
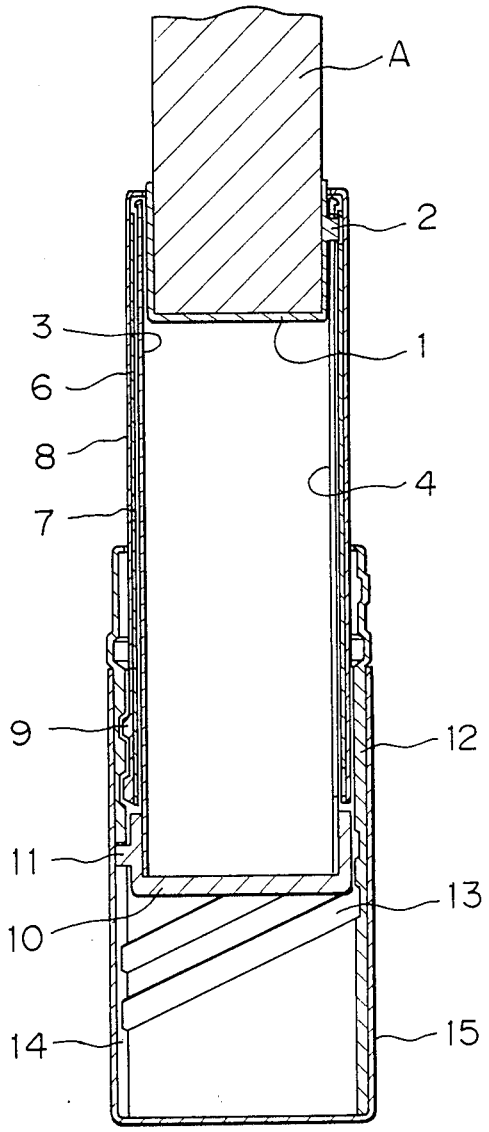
FIG. 2 is a sectional front view showing the embodiment of the present invention as shown in FIG. 1, in the extended state for delivering out the cosmetic stick.

Referring now to FIGS. 1 and 2, a middle saucer 1 for holding a cosmetic stick A is a bottomed cylinder and an engaging projection 2 is formed on the outer wall thereof. A longitudinal guide groove 4 is formed on a body cylinder 3 in which the middle saucer 1 is slidably inserted, so that the engaging projection 2 slides through the longitudinal guide groove 4. A projection 5 is formed along the periphery of the top end of the body cylinder 3. A right-hand flight groove 7 is formed on a threaded cylinder 6 fitted to the periphery of the body cylinder 3. The threaded cylinder 6 is inserted and secured in the cover cylinder 8. Thus, the delivering out of the cosmetic stick A is effected in such a manner that the engaging projection 2 of the middle saucer 1 slides through the guide groove 4 of the body cylinder 3 and becomes engaged with the right-hand flight groove 7 of the threaded cylinder 6.

Two second engaging projections 9 are formed on the outer wall of the lower portion of the cover cylinder 8. A bottomed slide cylinder 10 is inserted and secured in the outer wall of the lower end portion of the body cylinder 3, and a rotation-stopping piece 11 is projected on the outer wall of the slide cylinder 10. A middle cylinder 12 is provided so as to cover the cover cylinder 8 and two left-hand flight grooves 13 with which the engaging projections 9 of the cover cylinder 8 are engaged are formed parallel on the inner circumferential wall of the middle cylinder 12. Further, a longitudinal engaging groove 14 with which the rotation-stopping piece 11 of the slide cylinder 10 is slidably engaged is formed on the middle cylinder 12. Furthermore, the middle cylinder 12 is inserted and secured in a bottomed outer cylinder 15 and the top end periphery of the outer cylinder 15 is anchored on an anchoring projection 16 formed on the peripheral wall of the middle cylinder 12. A plurality of brackets 17 are projected on the middle cylinder 12 so that a topped cylindrical lid (not shown) is dismountably capped.

In the above-mentioned structure, when the outer cylinder 15 is rotated in the right-hand direction while holding the cover cylinder 8, the left-hand flight grooves 13 formed on the inner wall of the middle cylinder 12 contained and secured in the outer cylinder 15 are concurrently rotated in the right-hand direction. Then, since the engaging projections 9 formed on the cover cylinder 8 are engaged with the left-hand flight grooves 13, the cover cylinder 8 is moved to increase the length exposed from the inside of the middle cylinder 12. At that time, since the rotation-stopping piece 11 projected on the slide cylinder 10 inserted and secured in the body cylinder 3 is slidably engaged with the engaging groove 14 longitudinally formed on the wall of the middle cylinder 12, the body cylinder 3 is rotated in the right-hand direction with respect to the cover cylinder 8 and the threaded cylinder 6.

Thus, the middle saucer 1, along with the cosmetic stick A, is longitudinally moved in the body cylinder 3, since the engaging projection 2 formed on the outer wall of the middle saucer 1 contained in the body cylinder 3 and holding the cosmetic stick A thereon pierces through the guide groove 4 and is engaged with the right-hand flight groove 7. After use, if the outer cylinder 15 is rotated in the left-hand direction while holding the cover cylinder 8, the cover cylinder 8 is moved to decrease the length exposed from the middle cylinder 12 and the cosmetic stick A draws back into the body cylinder 3 to complete the contraction for containing the cosmetic stick A.

Figure 3:
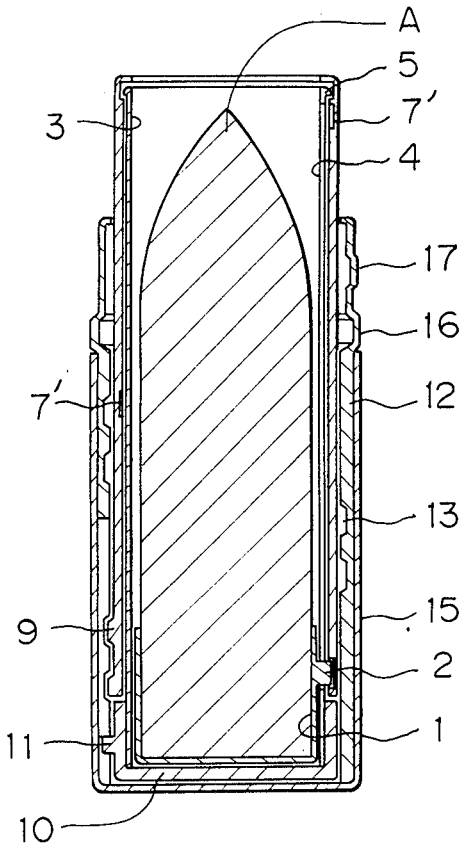
FIG. 3 is a sectional front view showing another embodiment of the present invention in the contracted state for containing a cosmetic stick therein.

A modification of the above-mentioned embodiment of the present invention is shown in FIG. 3. In the modification, a right-hand flight groove 7' with which the engaging projection 2 is engaged is formed on the inner circumferential wall of the threaded cylinder 6 and engaging projections 9 which are engaged with the left-hand flight grooves 13 formed on the inner circumferential wall of the middle cylinder 12 are formed on the outer wall of the lower portion of the threaded cylinder 6. In this case, even if the cover cylinder 8 described above is omitted, a slide type cosmetic stick vessel having the same functions as those of the vessel of the above-mentioned embodiment can be provided.

Figure 4:
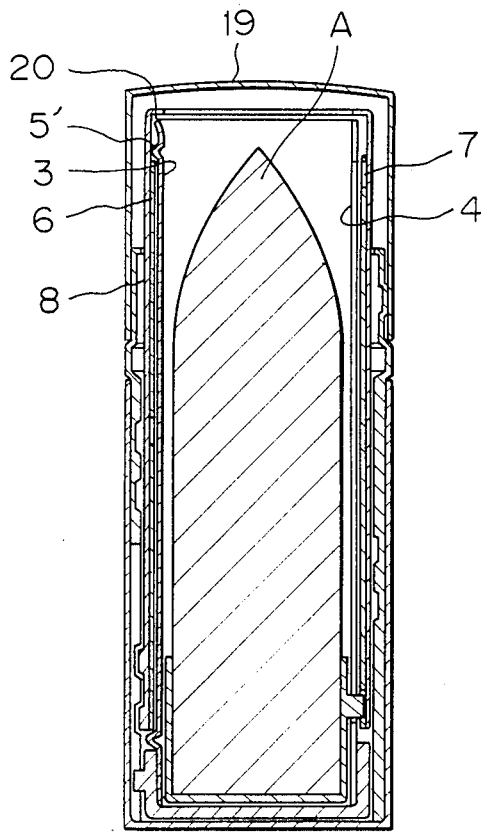
FIG. 4 is a sectional front view showing a third embodiment of the present invention in the contracted state for containing a cosmetic stick therein and covered with a topped cylindrical lid.
Figure 5:
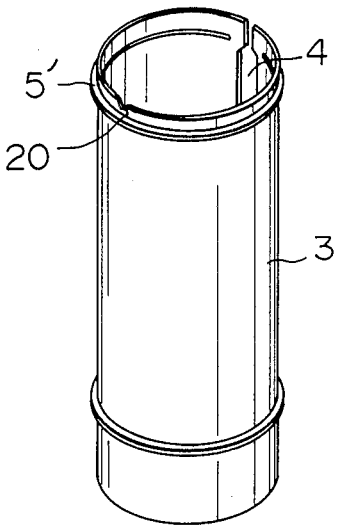
FIG. 5 is a perspective view showing a body cylinder for constituting the embodiment as shown in FIG. 4.

In a still further embodiment of the present invention as shown in FIGS. 4 and 5 an anchoring portion 20 is provided at the upper end of the body cylinder 1 by projecting a part of the upper end outside. The anchoring portion 20 contacts with the curled upper end of the cover cylinder 8 when the cover cylinder 8 moves down with respect to the body cylinder 1. Thus, the curled upper end of the cover cylinder 8 is prevented from moving down through the upper end of the body cylinder 1, even when an excessive power to force down the cover cylinder 8 is erroneously applied thereto. In this embodiment, a projection 5' is formed at a position near the top end of the body cylinder 3 but below the anchoring portion 20.

Figure 6:
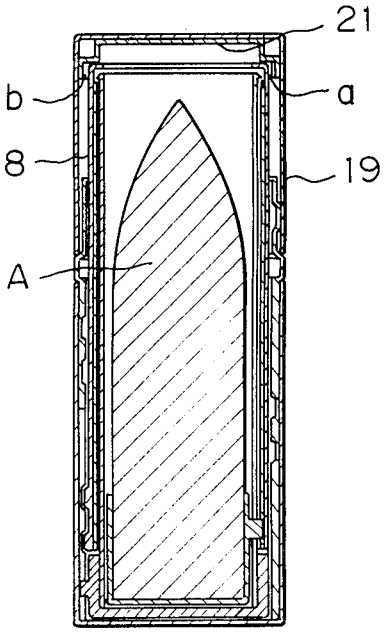
FIG. 6 is a sectional front view showing a fourth embodiment of the present invention in the contracted state for containing a cosmetic stick therein and covered with a topped cylindrical lid.
Figure 7:
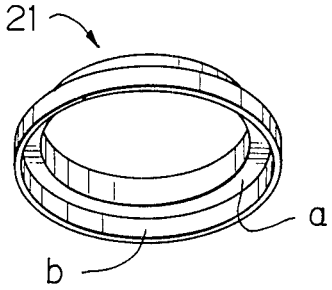
FIG. 7 is a perspective view showing an inner lid for constituting the embodiment as shown in FIG. 6.
Figure 8:
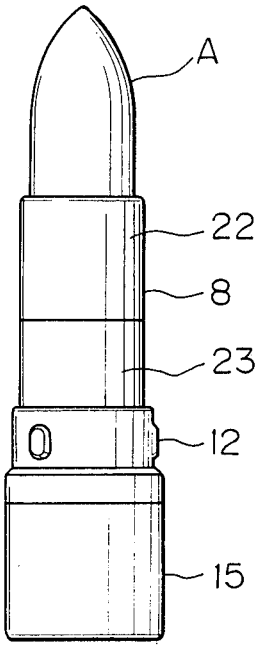
FIG. 8 is a front view showing a fifth embodiment of the present invention in the extended state for delivering out a cosmetic state; and, FIG. 9 is a front view showing the embodiment as shown in FIG. 8, in the contracted state for containing a cosmetic stick therein.
Figure 9:
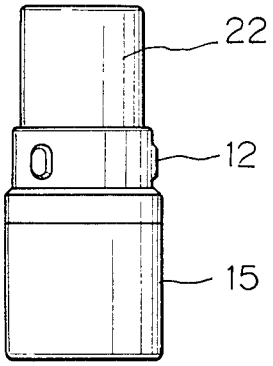

The topped cylindrical lid 19 as shown in FIG. 4 may be provided with an inner lid 21 as illustrated in FIGS. 6 and 7. The topped cylindrical lid 19 dismountably capped to be fitted to the upper portion of the middle cylinder 12 has the inner lid 21 inserted therein. The inner lid 21 is made of a convex metal with an open bottom b, which is provided, on its intermediate, with a shoulder a, and is secured to in the topped cylindrical lid 19 so as to prevent the inner lid 21 from coming out of-the topped cylindrical lid 19, so that the open bottom b of the inner lid 21 opens in the same direction as that of the topped cylindrical lid 19. The shoulder a acts to contact with the upper end of the cover cylinder 8 so as to prevent the cover cylinder 8 from coming out. Thus, if the topped cylindrical lid 19 is firmly capped, the cosmetic stick A is prevented from coming out to be damaged by the contact with the lid 19 during carrying.

The slide type cosmetic stick vessel of the present invention may have a marking on the outer wall of the cover cylinder 8 to make clearly visible the contracted and extended states, as shown in Fi9s. 8 and 9. The marking may be made by dividing the outer wall surface of the cover cylinder 8 to be exposed from the middle cylinder 12 in the extended state into two zones 22 and 23 by coloring or drawing a line. Thus, the zone 23 is exposed from the middle cylinder 12 in the extended state of the slide type cosmetic stick vessel, while the zone 23 is hidden by the middle cylinder 12 in the contracted state. If desired, the zones 22 and 23 may have differently colored protective coatings and/or may be indicated as the zone 22 being a zone to be exposed and the zone 23 being a zone to be hidden.

We claim:

1. A slide type cosmetic stick vessel comprising a middle saucer for holding a cosmetic stick, which has an engaging projection formed on the outer wall thereof, a body cylinder having a longitudinal guide groove through which the engaging projection slides, a threaded cylinder fitted on the periphery of the body cylinder, said threaded cylinder having a right-hand flight groove with which the engaging projection is engaged, a cover cylinder in which the threaded cylinder is inserted and secured, said cover cylinder having a second engaging projection formed on the outer wall of the lower portion thereof, a middle cylinder having a left-hand flight groove with which the second engaging projection is engaged, said left-hand flight groove being formed on the inner circumferential wall of the lower portion of the middle cylinder, and a longitudinal engaging groove formed on the wall of the middle cylinder, a slide cylinder secured to the outer wall of the lower end of the body cylinder and having a rotation-stopping piece formed on the outer wall thereof, and a bottomed outer cylinder in which the middle cylinder is inserted and secured, wherein the middle saucer and the slide cylinder are slidable in the longitudinal direction.

2. A slide type cosmetic stick vessel according to claim 1, wherein the threaded cylinder and the cover cylinder are integrally formed as a threaded cylinder having a right-hand flight groove formed on the inner circumferential wall thereof and a second engaging projection formed on the outer wall of the lower portion thereof.

3. A slide type cosmetic stick vessel according to claim 1, wherein the middle cylinder has two parallel left-hand flight grooves provided on the inner circumferential wall thereof, with which two second engaging projections are engaged.

4. A slide type cosmetic stick vessel according to claim 1, wherein an anchoring portion is provided at the upper end of the body cylinder.

5. A slide type cosmetic stick vessel according to claim 1, wherein a topped cylindrical lid is dismountably capped to be fitted to the upper portion of the middle cylinder.

6. A slide type cosmetic stick vessel according to claim 5, wherein the topped cylindrical lid has a convex inner lid inserted therein.

7. A slide type cosmetic stick vessel according to claim 1, further comprising a marking on the outer wall of the cover cylinder to make clearly visible the contracted and extended states of the vessel.

* * * * *